US007963281B2

(12) United States Patent
Pong

(10) Patent No.: US 7,963,281 B2
(45) Date of Patent: Jun. 21, 2011

(54) ELECTRIC TOY GUN AND MOTION CONTROL MECHANISM THEREOF

(75) Inventor: Jackie Chun Chung Pong, Hong Kong (HK)

(73) Assignee: Yick Fung Industrial International Limited, Tuen Mun, New Territories (HK)

( * ) Notice: Subject to any disclaimer, the term of this patent is extended or adjusted under 35 U.S.C. 154(b) by 369 days.

(21) Appl. No.: 12/290,520

(22) Filed: Oct. 30, 2008

(65) Prior Publication Data

US 2009/0217919 A1 Sep. 3, 2009

(30) Foreign Application Priority Data

Feb. 29, 2008 (CN) ..... 2008 2 0006419 U

(51) Int. Cl.
*F41B 11/00* (2006.01)

(52) U.S. Cl. ..... 124/67; 124/65; 124/66; 124/68

(58) Field of Classification Search ..... 124/65, 124/66, 67, 68
See application file for complete search history.

(56) References Cited

U.S. PATENT DOCUMENTS 5,975,068 A * 11/1999 Halter et al. ..... 124/63
7,100,592 B1 9/2006 Yang
7,287,526 B1 * 10/2007 Bligh et al. ..... 124/63
7,694,448 B2 * 4/2010 Iwasawa ..... 42/54
2005/0188974 A1 * 9/2005 Pedicini et al. ..... 124/65
2009/0050128 A1 * 2/2009 Mitchell ..... 124/66

FOREIGN PATENT DOCUMENTS

| | | | |
|---|---|---|---|
| CN | 2509548 | Y | 9/2002 |
| CN | 1425892 | A | 6/2003 |
| CN | 200975855 | Y | 11/2007 |
| CN | 200982833 | Y | 11/2007 |
| JP | 2000-234896 | | 8/2000 |
| JP | 2006-300462 | | 11/2006 |

* cited by examiner

*Primary Examiner* — Troy Chambers
*Assistant Examiner* — Gabriel J Klein
(74) *Attorney, Agent, or Firm* — Heslin Rothenberg Farley & Mesiti P.C.; Victor A. Cardona, Esq.

(57) ABSTRACT

This invention is a motion control mechanism for use in electric toy guns. The mechanism includes a gear set, a piston set that is inside the electric toy gun's body and driven by the said gear set, a primary repositioning spring that is between the said piston set and the toy gun's rear end, and the repositioning set that is installed on the gun body, and moves backward when driven by the said piston set. The said repositioning set is fixed to the piston set, and will move backward when driven by the gear set. It will then reposition itself by the force of primary repositioning spring. The electric toy guns with this invention have the following advantageous features: Since it has a repositioning set, and air release holes, it provides for motions that are more similar to those of real guns. Thus it is more suited for military training and lasts longer.

9 Claims, 4 Drawing Sheets

ELECTRIC TOY GUN AND MOTION CONTROL MECHANISM THEREOF

TECHNICAL FIELD OF THE INVENTION

The present invention is concerned with an electric toy gun and in particular a motion control mechanism for use in an electric toy gun.

BACKGROUND OF THE INVENTION

In recent years, electric toy guns have become very popular and they are widely used in outdoor war games and in military training. Electric toy guns and real guns have similar appearance. The general mechanism of conventional electric toy guns is that when they are triggered, a battery-powered gear set therein will backwardly drive a piston set in a gun chamber thereof. When the piston set is driven backwardly, a spring between a rear wall of the chamber and the piston set is compressed. When the gear set rotates to a predetermined position, the piston set is released. The spring will then push the piston set forward such that pressurized air in the chamber will drive a BB bullet to be ejected from a barrel of the gun. It can thus be understood that after a shot is fired, the gun will be ready for another shot right away. Since all parts in a conventional electric toy gun are hidden, users would not be able to see operation of various parts in the gun, and would not know the difference between the operation of the parts in a conventional electric toy gun and that of a real gun. Nevertheless, due to the difference in the mechanism between conventional electric toy guns and real guns, in the context of military training conventional electric toy guns are of limited use.

The present invention seeks to address problems arisen from limited similarity between conventional electric toy guns and real guns, and from reduced usage in certain contexts such as in military training. In other words, the present invention seeks to provide an electric toy gun which has a motion control mechanism; the gun can produce a shooting behavior which is similar to a real gun.

According to one aspect of the present invention, there is provided a motion control mechanism for use in an electric toy gun. The motion control mechanism includes a gear set, a piston set that is inside a gun body of the electric toy gun. The piston is driven by the gear set. The motion control mechanism also includes a primary repositioning spring located between the piston set and a rear end of the gun. The repositioning set is installed on the gun body, and moves backward when driven by the piston set.

Preferably, the repositioning set may include a repositioning rod and a recoil mass. The repositioning rod and the recoil mass are fixed together. One end of the repositioning rod is downwardly extending. The downwardly extending end of the repositioning rod is positioned behind the piston set and is located in a position to a central axis of the gun body when compared to a highest part of the piston set. The other end of the said repositioning rod is fixed to the recoil mass.

The repositioning set may include a secondary repositioning spring. The secondary repositioning spring may be located between the repositioning rod and a front wall of the chamber of the gun body. The secondary repositioning spring may be configured to be able to, in use, pull the repositioning rod and the recoil mass back to an original position.

The repositioning set may include a secondary repositioning spring. The secondary repositioning spring may be located between the repositioning rod and a front wall of the chamber of the gun body. The secondary repositioning spring may be configured to pull the repositioning rod and the recoil mass back to an original position.

The motion control mechanism may include a gliding slot set in a rear upper end of the chamber of the gun body. The gliding slot set may have at least one pair of bulges and is arranged in parallel with the central axis of the chamber and extends to an exterior of the chamber. The gliding slot set may have a gliding slot that matches the bulges and allows the repositioning rod to glide along the gliding slot.

The repositioning rod may have two pairs of bulges. Based on the distance between the repositioning rod and the central axis of the chamber's central axis, these two pairs of bulges may be called a first bulge and a second bulge. The gliding slot set may have two gliding slots that match the first bulge and the second bulge. The first bulge may be situated farther away from the central axis of the chamber than that of the second bulge, and the first bulge may be wider in width.

The motion control mechanism may provide a positioning hole at one end of said repositioning rod, the one end being attached to the recoil mass. The motion control mechanism may provide another positioning hole in an upper surface of the recoil mass, the position of this another positioning hole matches that of the positioning hole of the repositioning rod. A connection means is, for example, in the form of a screw, may pass through these two positioning holes in the repositioning rod and the recoil mass such that the repositioning rod and the recoil mass are fixed together.

The secondary repositioning spring may be provided with one end which is fixed to one end of the repositioning rod, and the other end of the secondary repositioning spring may be fixed to the inner front wall of the chamber.

The motion control mechanism may provide at least one air release hole at a rear end of the chamber such that cavity in the rear part of the chamber and exterior of the mechanism are in gas communicable relationship.

The motion control mechanism may be configured such that an axis of the air release hole may be arranged vertically to the central axis of the chamber, and may extend across the chamber.

It can be understood that a number of benefits are produced by the above described electric toy gun. For instance, the electric toy gun is more similar and behaves similarly to a real gun in that it also has a repositioning set and air release holes and generates a similar feel as one would sense when using a real gun. As such, a gun made according to the present invention is more suited for military training and can last longer.

DETAILED DESCRIPTION

Figure 1:
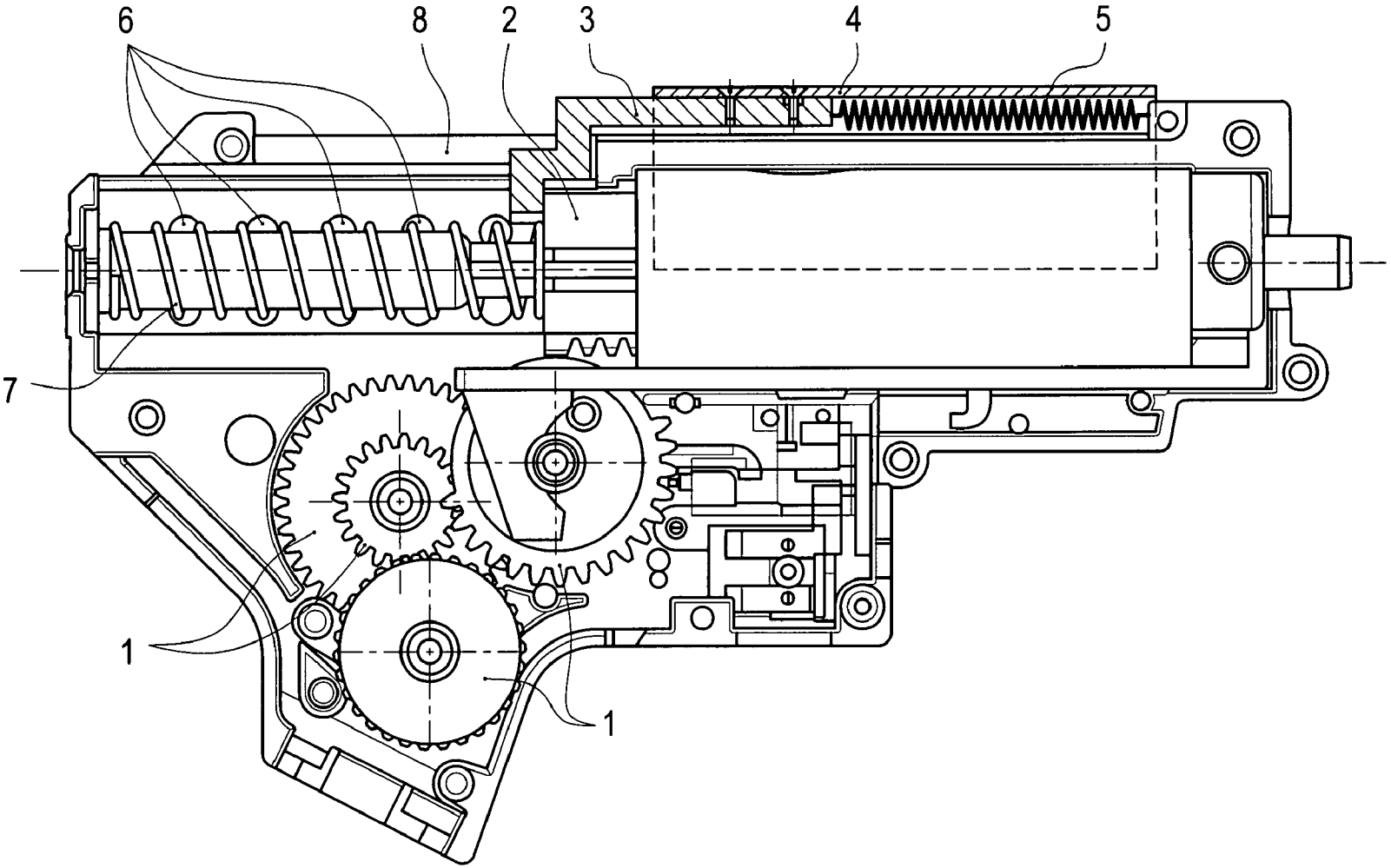
FIG. 1 is a schematic view showing an electric toy gun and illustrates the position and structure of a repositioning set in a gun chamber of a motion control mechanism of an electric toy gun according to an embodiment of the present invention.

An embodiment of an electric toy gun in accordance with the present invention is illustrated in FIG. 1. The toy gun comprises a motion control mechanism having a gear set 1, a piston set 2, a repositioning rod 3, a recoil mass 4, a gliding set 8, a primary repositioning spring 7, a secondary repositioning spring 5, and an air release hole 6. The repositioning rod 3, the recoil mass 4, and the repositioning spring 5 are fixed together to form a repositioning set. The repositioning set is installed on the upper part of the chamber of the electric toy gun, while the recoil mass 4 is positioned externally to the chamber, and the recoil mass can be seen from the exterior of the electric gun. The gliding set 8 is in the upper rear part of the chamber, and two sets of gliding slots are provided on the gliding set 8. The repositioning rod 3 is provided with two pairs of bulges which correspondingly fit into the gliding slots. The gear set 1 and the piston set 2 are placed inside the chamber, not visible from the exterior of the electric gun. When a shot is being fired from the electric gun is fired, its battery (not shown) the figure) will drive the motor (not shown) to rotate, and the rotating motor will drive the gear set to rotate accordingly. It can be understood that since gear teeth are provided on an edge of one of the gears, and the piston set 2 is provided with a lower edge with matching teeth, when the gear rotates counterclockwise, its teeth engage with the teeth of the piston set 2, thus driving the piston set 2 backward, and pressing the primary repositioning spring 7. When the piston set 2 finally moves to the end of the chamber, as shown in FIG. 1, the last tooth on the gear engages with the last tooth of the piston set 2. At this time, the piston set 2 has moved to the end of the chamber. It can be understood that the primary repositioning spring 7 has reached a maximum or farthest position. As the gear set 1 rotates further counterclockwise, since there is no further tooth on the gear to engage with, the piston set 2 becomes released. The primary repositioning spring 7 will then push the piston set 2 forward, and as a result highly compressed air will drive a BB bullet out through the barrel of the gun, when at that time the piston set 2 continues moving forward to the starting position, driven by the primary repositioning spring 7.

Figure 2:
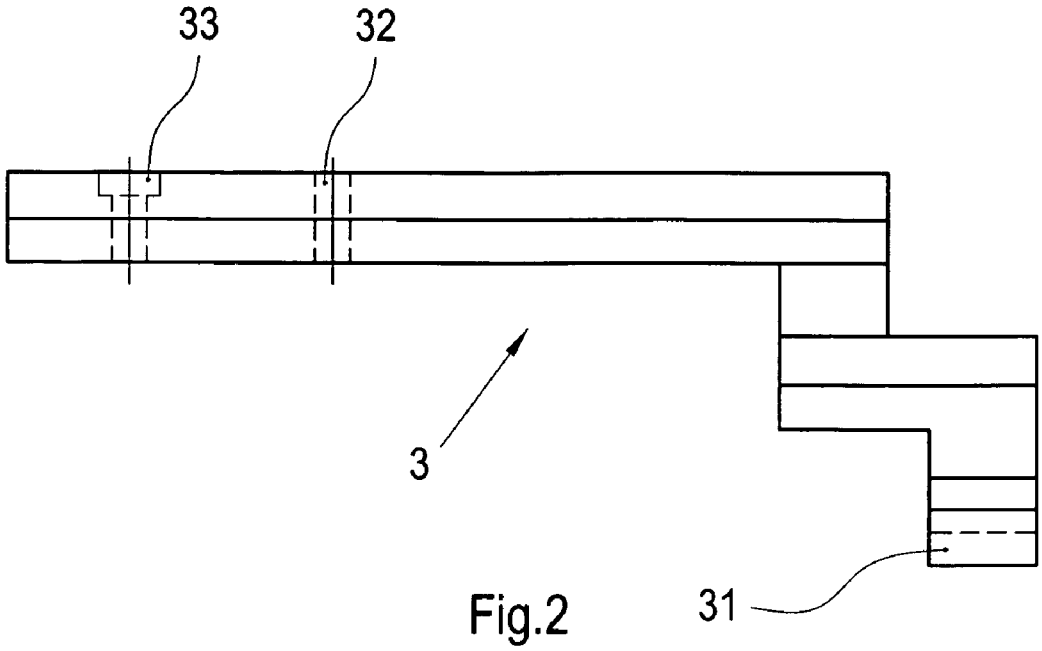
FIG. 2 illustrates the general profile of a repositioning rod in the gun chamber of the motion control mechanism of the electric toy gun shown in FIG. 1.
Figure 3:
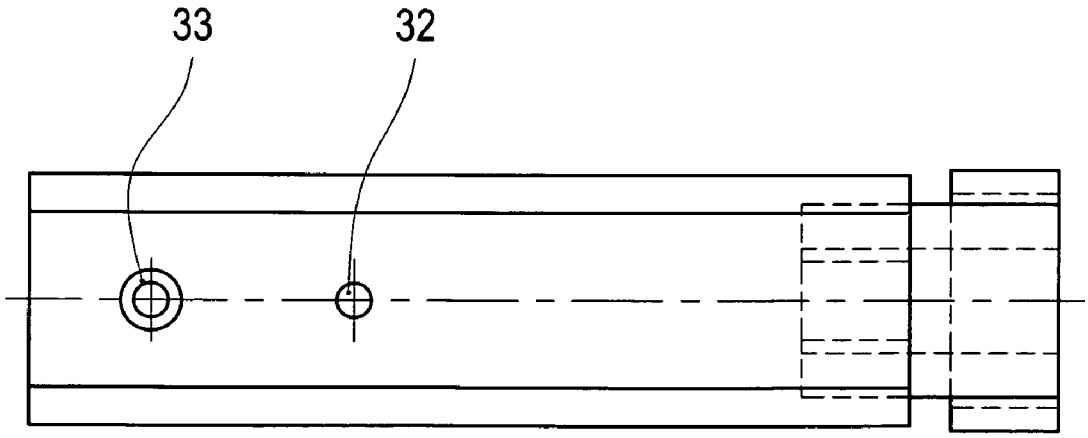
FIG. 3 shows a top view of the repositioning rod shown in FIG. 2.
Figure 4:
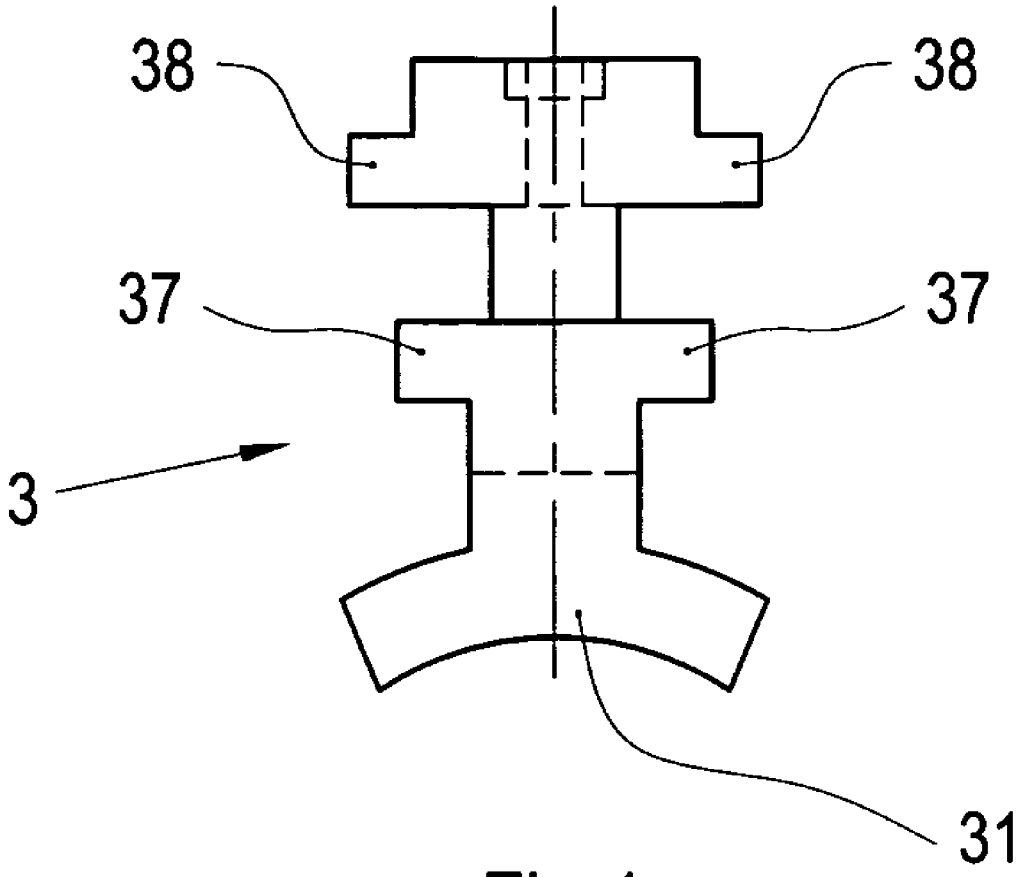
FIG. 4 shows a left view of the repositioning rod shown in FIG. 2.
Figure 5:
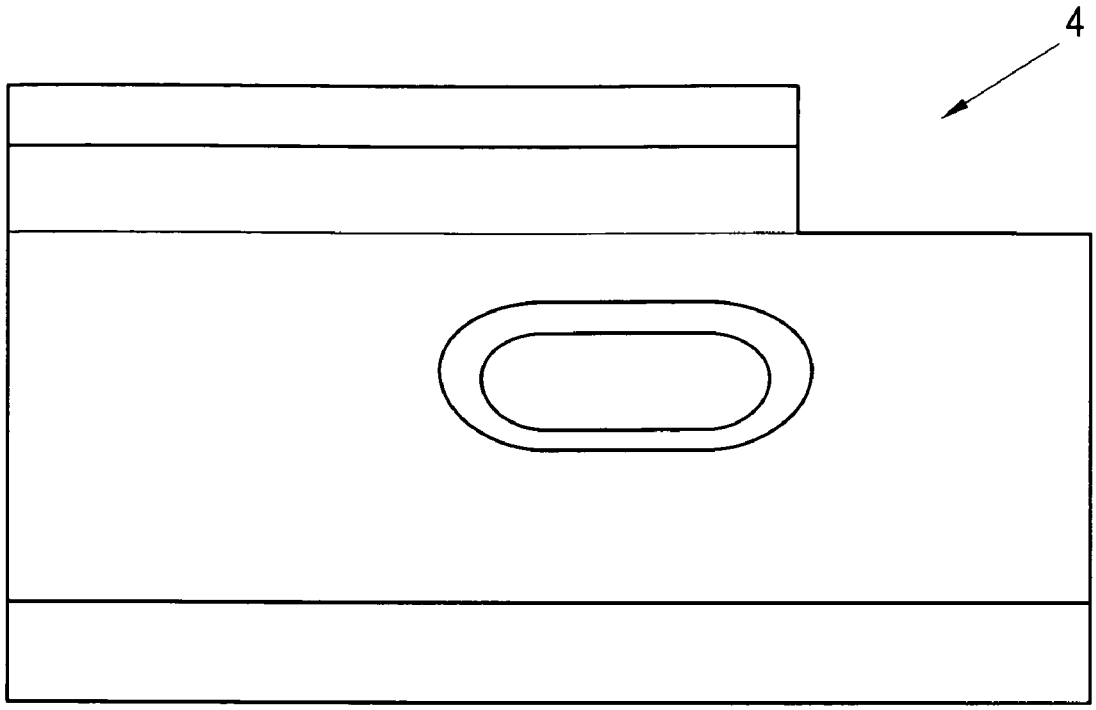
FIG. 5 illustrates the general profile of a recoil mass in the gun chamber of the electric toy gun shown in FIG. 1.
Figure 6:
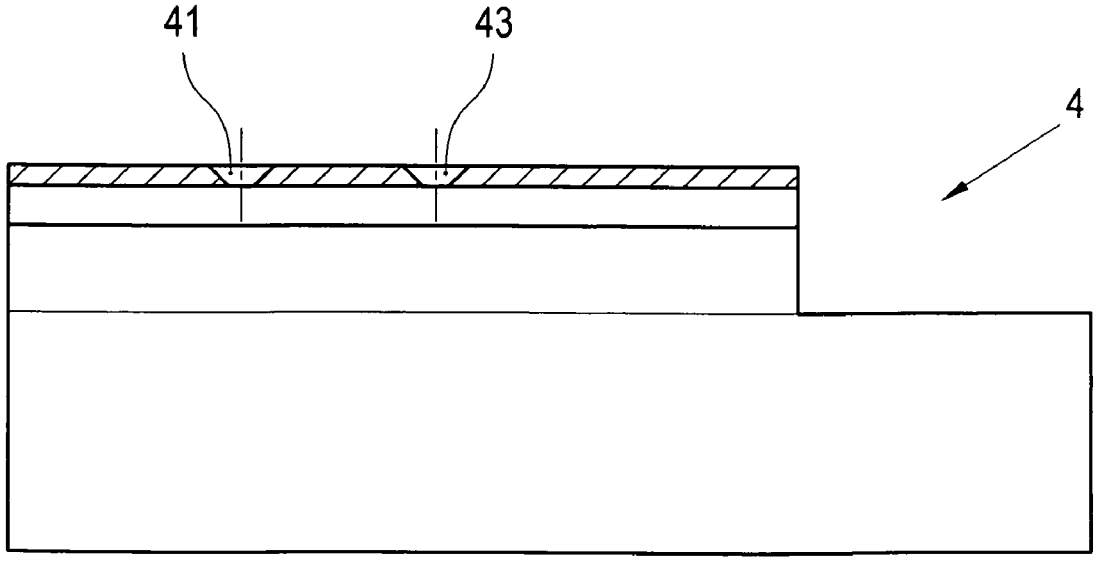
FIG. 6 shows a cross section view taken at a central axis of the recoil mass shown in FIG. 5.

The repositioning rod 3, the recoil mass 4, and the repositioning spring 5 are fixed together to form a repositioning set. As shown in FIGS. 2, 3 and 4, the repositioning rod 3 extends downwardly to form a rod extension 31. Positioning holes 32 and 33 are provided on a top upper level of the repositioning rod 3. As shown in FIGS. 5 and 6, the recoil mass 4 is provided with positioning holes 41 and 43. One end of the secondary repositioning spring 5 is fixed to the repositioning rod 3, and the other end is fixed to a top of a front wall of the chamber, as illustrated in FIG. 1. It will extend on action of an external force. When the external force is removed, it will retract to its original default position. An upper portion of the repositioning rod 3 extends into the recoil mass 4. The positioning holes 32 and 33 that are located on this end match with the positioning holes 41 and 43 on the recoil mass, and they are fixed together by a connection means such as a screw. It can be understood that the repositioning rod 3, the recoil mass 4, and the repositioning spring 5 are fixed together to form a repositioning set.

The repositioning rod 3 is connected to the chamber by embedding into the gliding slots of the gliding slot set 8, which is situated on the top of the chamber. The repositioning rod 3 has two pairs of bulges, which are located in different locations away from the central axis of the chamber. The bulges are shown in FIG. 4 and are namely, a first bulge 38 and a second bulge 37. The gliding set includes gliding slots which are in locations corresponding to the first bulge 38 and the second bulge 37. The first bulge 37 is situated further away from the central axis of the chamber than the second bulge 37, and is wider in width compared to the second bulge 37. The recoil mass 4 is installed on the exterior surface of a top front side of the chamber. When installing the repositioning set, the downward extension 31 of the repositioning rod 3 is located behind a starting point of the piston set 2. In other words, the extension 31 is closer to the rear end of the chamber than the piston set 2, and is closer to the central axis of the chamber than a highest point of the piston set 2. It can be understood that when the gear set 1 drives the piston set 2 to move backward, the rear end of piston set 2 will push the downward extension 31 of the repositioning rod 3 to move backward. Since the repositioning rod 3, the recoil mass 4, and the secondary repositioning spring 5 are fixed together, the repositioning rod 3 will drive the recoil mass 4 backward, and stretch the secondary repositioning spring 5. Similarly, when the gear set 1 releases the piston set 2, the primary repositioning spring 7 will push the piston set 2 forward, and the secondary repositioning spring 5 will retract under its elastic force, leading the recoil mass 4 and the repositioning rod 3 to glide forward.

In an alternative implementation, the bulges on the repositioning rod and the gliding slots on the said gliding slot set are interchangeable, i.e., the gliding slots can be set on the repositioning rod and the corresponding bulges will then be positioned on corresponding areas of the gliding slot set.

When the piston set 2 moves back and forth within the chamber, air in the rear part of the chamber is driven in or sucked out such that air pressure therein is balanced. However, if an electric toy gun lacked an air passageway or an air passageway that was large enough to connect cavity in the rear part of the chamber and the surroundings of the chamber or the electric toy gun, movement of the piston set 2 and repositioning set within the chamber would be hindered due and would not be smooth due to air resistance. The lack of air passageway would also cause serious wear and tear to various parts in the gun. In an embodiment, a similar electric toy gun is provided with several air holes 6 at the rear end of the chamber. These air holes 6 are positioned such that each of the air holes 2 defines an axis that is vertical in relation to the central axis of the chamber, and extends across the chamber entirely to connect the cavity in the rear part of the chamber to the surroundings. When the piston set 2 moves back and forth in the chamber, these air holes 6 can serve to rapidly release the air in the rear part of the chamber to the surroundings, or rapidly suck in air from the surroundings into the rear part of the chamber. The provision of the air holes 6 allows the piston set 2 and the repositioning set of the electric toy gun to operate smoothly and last longer.

The invention claimed is:

1. An electric toy gun comprising a gun body having a front end and a rear end, and means for controlling motion of parts in said gun body, said means for controlling including:

a) a gear set;

b) a piston set arranged within said gun body and driven by said gear set;

c) a primary repositioning set arranged between said piston set and the rear end of said gun body, said repositioning set backwardly movable when driven by said piston set;

d) a secondary repositioning spring;

wherein:

i) said repositioning set includes a repositioning rod having a front end and a rear end, and a recoil mass;

ii) a first end of said repositioning rod is fixedly connected to said recoil mass;

iii) a second end of said repositioning rod is downwardly extending, and is positioned behind said piston set and is closer to a central axis of said gun body than a highest part of said piston set;

iv) said second repositioning spring is arranged between said repositioning rod and a front wall of a chamber of said gun body; and v) in use when said gun is fired, said recoil mass moving from an original position to a firing position, said secondary repositioning spring pulling said repositioning rod such that said recoil mass is returned from said firing position to said original position.

2. An electric toy gun as claimed in claim 1, wherein a rear end of the chamber is provided with an air release hole, and a cavity defined in a rear part of the chamber and surroundings of said gun are in a fluid communicable relationship.

3. An electric toy gun as claimed in claim 2, wherein said air release hole defines an axis vertical to a central axis of the chamber, and extends across the chamber.

4. An electric toy gun as claimed in claim 1, wherein said recoil mass is arranged on top of said chamber of said gun body, and said repositioning rod is arranged on top of the chamber of said gun body, and one end of said repositioning rod is fixedly connected to and extends into said recoil mass.

5. An electric toy gun as claimed in claim 4, further comprising a gliding slot set in an upper rear end of the chamber of said gun body, wherein said repositioning set is provided with at least one pair of bulges arranged in parallel to the central axis of the chamber and extending to the exterior of the chamber, and said guiding slot set.

6. An electric toy gun as claimed in claim 5, wherein:

i) said gliding slot set is provided with two gliding slots;

ii) said repositioning rod is provided with a first bulge and a second bulge;

iii) said gliding slots and said first bulge and second bulge are in a matching relationship;

iv) said first bulge is further away from the central axis of the chamber then said second bulge; and v) said first bulge is wider than said second bulge.

7. An electric toy gun as claimed in claim 6, further comprising a connection means, wherein:

i) said repositioning rod includes an end having a first positioning hole;

ii) said repositioning rod includes an end defining an upper surface;

iii) said repositioning rod is attached to said recoil mass, and said recoil mass has an upper surface provided with a second positioning hole;

iv) said first positioning hole and said second positioning hole are in a matching configuration such that said connection means passes through said first and second positioning holes for connecting said repositioning rod and said recoil mass.

8. An electric toy gun as claimed in claim 7, wherein said secondary repositioning spring is provided with a first end connected to an end of said repositioning rod, and a second end of said secondary repositioning spring is connected to an inner front wall of the chamber.

9. An electric toy gun as claimed in claim 7, wherein said connection means is in the form of a screw.

* * * * *